United States Patent [19]

Ruppel et al.

[11] 4,429,791

[45] Feb. 7, 1984

[54] MIRROR PACKAGE AND METHOD OF FORMING

[75] Inventors: Anthony D. Ruppel; Monte Williams; Larry Willis, all of Vincennes, Ind.

[73] Assignee: Hamilton Glass Products Incorporated, Vincennes, Ind.

[21] Appl. No.: 383,590

[22] Filed: Jun. 1, 1982

[51] Int. Cl.[3] ..... B65D 5/02; B65D 25/00

[52] U.S. Cl. ..... 206/454; 206/45.31; 206/453; 229/87 R

[58] Field of Search ..... 206/45.31, 453, 454, 206/424, 586; 229/87 R

[56] References Cited

U.S. PATENT DOCUMENTS 3,516,593 6/1970 Larsen ..... 206/424

3,586,234 6/1971 Nathan et al. ..... 206/454

3,602,367 8/1971 Nathan et al. ..... 206/454

3,622,066 11/1971 Saferstein ..... 229/87 R

*Primary Examiner*—William T. Dixson, Jr.

*Assistant Examiner*—Brenda J. Ehrhardt

*Attorney, Agent, or Firm*—Robert E. Browne; Ralph R. Rath

[57] ABSTRACT

A mirror and package combination includes a single sheet of material that is folded to produce multiple-ply edge protectors along opposite edges and opposite ends of the mirror and completely encloses the peripheral edge of the mirror frame normally associated with such mirror. The package is formed by producing a plurality of fold lines on flaps that extend from a main body of a sheet to produce multiple-ply thickness supports at opposite ends of the mirror and also multiple-ply thickness supports along opposite sides of the mirror.

11 Claims, 7 Drawing Figures

FIG. 1
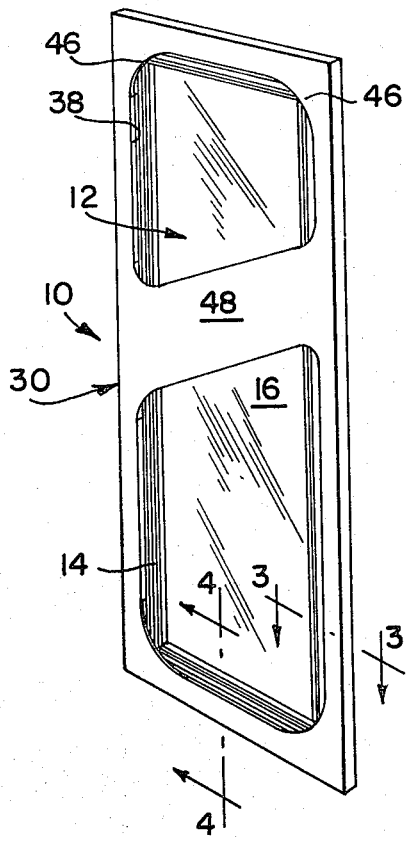
FIG. 2
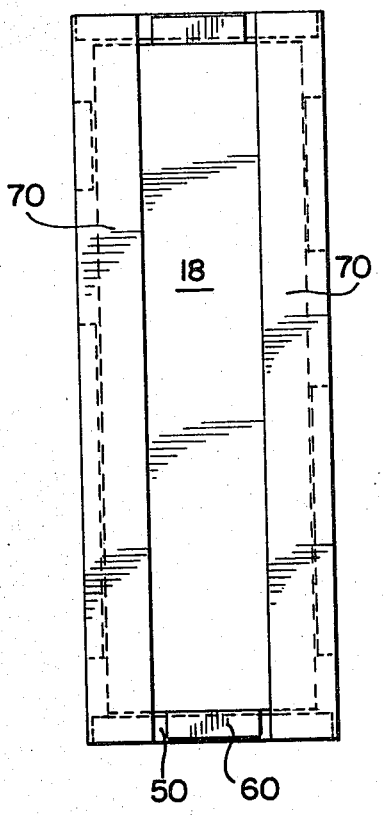
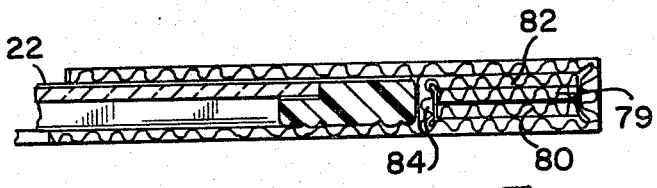
FIG. 3
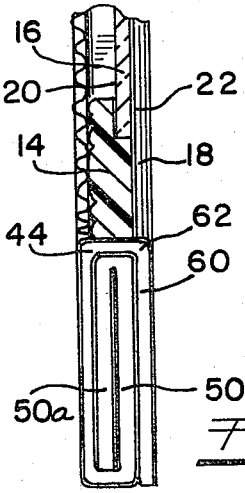
FIG. 4

MIRROR PACKAGE AND METHOD OF FORMING

DESCRIPTION

1. Technical Field

The present invention relates generally to packaging and, more specifically, to providing a rigid package around a mirror that is designed to fully protect the edges of the mirror and allow the mirror to be displayed for sale.

2. Background Prior Art

Rectangular full-length door mirrors have become rather popular in recent years. These mirrors generally are substantially greater in length than in width.

Most mirror manufacturers of this type of mirror have attempted to package the mirror in such a manner that it can be displayed for visual inspection while remaining within the package. Various type of packages have been developed and are being utilized commercially for shipment and display of this type of mirror.

One type of package that has been developed and is being used commercially consists of a generally rectangular sheet of cardboard that is slightly greater in dimension than the mirror that is to be packaged. A narrow strip of cardboard extends across the center of the mirror and is stapled to the rectangular sheet. Opposite end pieces are utilized that have a portion extending across the end of the mirror and triangular portions extending across the respective corners of the mirror and are again stapled to the main sheet so that the majority of the mirror is exposed for display.

Another type of mirror package that is presently being used commercially consists of a generally rectangular cardboard sheet that surrounds the mirror and has an integral portion extending across the center of the mirror. In this package, separate inserts are provided at opposite ends of the mirror to produce somewhat of a ledge for supporting the weight of the mirror during shipment and display.

While attempts have been made to provide a more rigid package at less expense, none has been found to be fully effective for completely protecting the peripheral edge of the mirror during shipment and display.

SUMMARY OF THE INVENTION

According to the present invention, a method has been developed for producing a package from a flat sheet that will provide rigid support along opposite ends and along opposite sides of the package while still allowing the package to be designed such that it can be used for displaying the mirror for sale.

A flat sheet is designed to have a plurality of flaps that have fold lines to produce segments that can be folded to provide multiple plies of protection along opposite sides and opposite ends of the mirror.

More specifically, the sheet includes a main body that has a generally rectangular opening having a peripheral edge opposite ends and opposite sides. A first pair of outwardly-directed end flaps, each having a plurality of spaced fold lines, extends from the periphery of the main body which are foldable to produce a multi-ply thickness that is in contiguous engagement with the main body on opposite ends. A second pair of inwardly-directed end flaps have a single fold line spaced from the peripheral edge and are foldable to encompass or enclose the multiple-ply thickness. The opposite sides of the main body have a third pair of inwardly-directed side flaps that each have a plurality of spaced fold lines to produce a multiple-ply thickness alone opposite sides of the main body and a fourth pair of outwardly-directed side flaps, each having a single fold line and foldable to encompass or surround the multiple-ply thickness on opposite sides of the main body. The generally rectangular opening in the main body of the sheet also has arcuate corners so that the main body extends across each of the corners of the mirror when the package is completed. In addition, the main body has an integral strip extending generally across the center of the opening so that the arcuate corners and the strip define retention means for retaining the mirror within the package.

The resulting package is one that can easily be mass produced at minimum cost and yet provides rigid support on opposite ends and opposite sides of the mirror. The package protects the entire opposite sides and opposite ends of the mirror while still exposing the majority of the mirror for inspection during display.

BRIEF DESCRIPTION OF SEVERAL VIEWS OF DRAWINGS

FIG. 1 is a perspective view of the mirror and package of the present invention;

FIG. 2 is a rear elevational view of the mirror and package;

FIG. 3 is a cross-sectional view, as viewed along line 3—3 of FIG. 1;

FIG. 4 is a cross-sectional view, as viewed along line 4—4 of FIG. 1;

DETAILED DESCRIPTION

Figure 5:
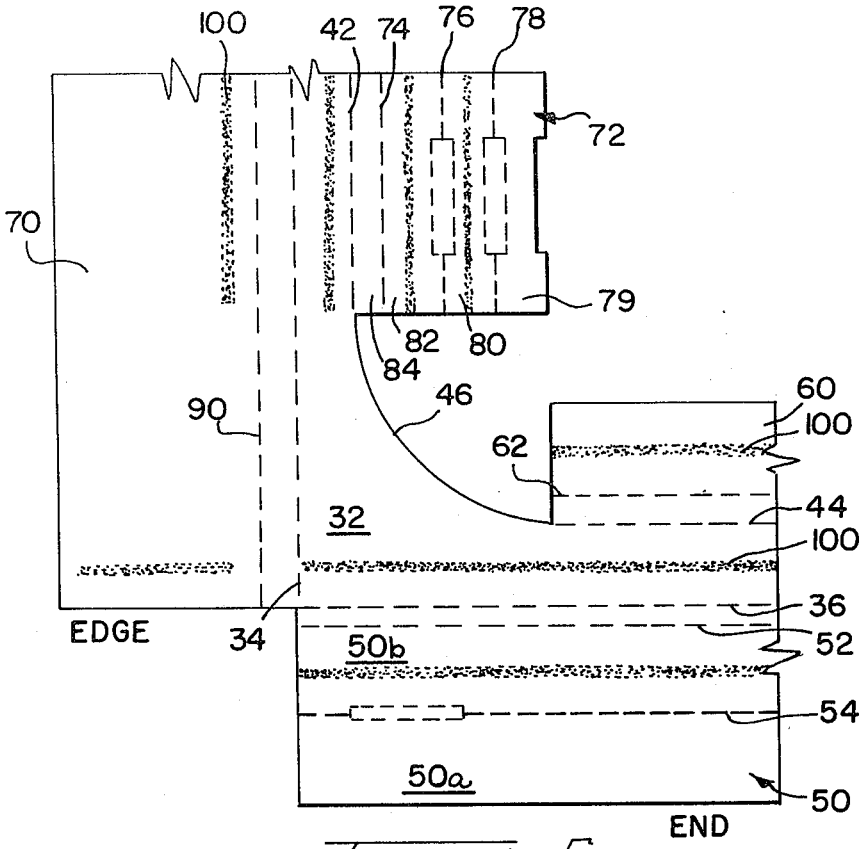
FIG. 5 is a fragmentary plan view of the sheet prior to being folded into the package illustrated in FIG. 1.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 of the drawings illustrated in perspective view a mirror and package constructed in accordance with the teachings of the present invention and generally designated by reference numeral 10. The mirror 12 consists of a peripheral frame 14 (FIG. 4) that surrounds the main body 16 of the mirror and a backing element 18. The rectangular mirror can be considered to have opposite sides and opposite ends along with a front surface 20 and a rear surface 22, as will be described later.

The main package 30(FIG. 1) can be formed from a sheet of flat material, illustrated in FIG. 5. The sheet is preferably formed from corrugated cardboard and has a main body 32, the periphery of which is defined by side edge fold lines 34 and end edge fold lines 36. The main body 32 has a generally rectangular opening 38 that is partially defined by inner fold lines 42 along opposite sides of the main body and opposite ends fold lines 44. The respective corners of the opening 38 have arcuate corners 46, the purpose of which will be described later. The main body 32 also has an integral strip 48 (FIG. 1)

extending generally across the center thereof and forms part of the retention means that will be described later.

According to the present invention, the main body has a plurality of foldable flaps on opposite sides, as well as opposite ends, which are foldable to provide multiple-ply edge protectors for the mirror, particularly the periphery of the frame 14.

As illustrated in FIG. 5, the main body has a first pair of outwardly-directed end flaps 50 (only one being shown), each of which has a plurality of fold lines including a first fold line 52 and a second fold line 54 dividing flap 50 into segments 50*a* and 50*b*. The end flap 50 is adapted to first be folded along fold line 54 to produce a double-ply thickness of material along one side of main body 32. The fold line 52 is spaced from and extends parallel to fold line 36 defining the perimeter of the main body and the spacing is such that it corresponds to approximately the thickness of the multiple-ply remainder of the end flap. Thus, the end flap can be first folded upon itself along fold line 54 to produce a double-ply thickness of material and then folded along fold line 52 and subsequently along fold line 36 to produce a triple-ply thickness of material along the end of the mirror.

Each end portion of the main body also has an inwardly-directed flap 60 that has a single fold line 62 spaced inwardly and extended parallel to fold line or edge 44 of opening 38. The spacing between fold lines 44 and 62 is such that it is equivalent to approximately three times the thickness of the sheet of material so that the inwardly-directed flap 60 can be folded repsectively along fold lines 44 and 62 to substantially encompass the outwardly-directed, multiple-ply thickness of flap 50. As will be appreciated from an inspection of FIG. 5, flaps 50 extend across the entire lower edge of the main body 32 while flaps 60 cover only the main center portion of the lower end of the mirror so that the basic rigidity of the end support is along the central portion of the end of the mirror.

The end result of the folding is shown in FIG. 4 where it will be seen that the resultant folding of the flaps 50 and 60 will produce compact multi-ply edge support for opposite ends of the mirror 12 and on which is virtually impossible to collapse even if the mirror and package are dropped. Furthermore, the thickness of the resultant end piece is slightly greater than the thickness of the mirror frame so that the edges are fully protected during shipment and storage.

The opposite sides of the sheet also have outwardly- and inwardly-directed flaps 70 and 72 extending from the main body 32 and foldable to produce multi-ply protection on opposite sides of the mirror. As illustrated in FIG. 5, main body 32 has a pair of outwardly-directed flaps 70 and a pair of inwardly-directed flaps 72 (only one being shown in FIG. 5). Inwardly-directed flap 72 has three spaced fold lines 74, 76 and 78 extending parallel to each other. The fold lines are preferably spaced a desired dimension such that the flap 72 is divided into four segments 78, 80, 82 and 84. Segments 78, 80 and 82 are adapted to be folded upon themselves along respective fold lines 78, 76 and 74, to produce a triple-ply thickness covered along the inner edge by segment 84, as illustrated in FIG. 3. This triple-ply thickness is interrupted by strip 48 to divide the side edge protectors into segments.

The outwardly-directed flap 70 has a score line 90 which is spaced from and parallel to fold line 34 by a dimension that is equal to the thickness of the triple-ply layer of material resulting from the folding of the inner flap 72. The flap 70 has a transverse dimension between its outer edge and fold line 90 which is substantially greater than the transverse dimension of the multiple-ply segment so that when folded along fold lines 34 and 90, the outwardly-directed flap will cover the entire multi-ply flap 72 and a portion of the mirror to retain the mirror within the completed package. It will also be noted in FIG. 2 that the outwardly-directed flap 70 also overlaps with the double-ply thickness of material of flap 50 on opposite ends of the mirror. Furthermore, flaps 60 at opposite ends of the package span almost the entire space between the free edges of flaps 70.

Figure 6:
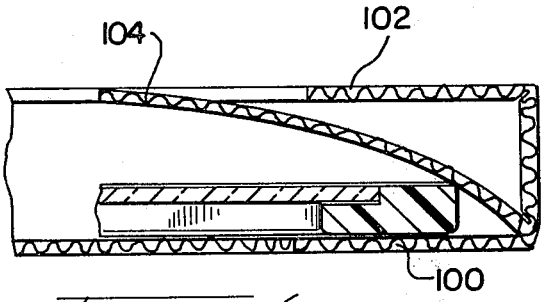
FIG. 6 PRIOR ART
FIG. 6 is a fragmentary cross-sectional view showing the side of a prior art package; and, FIG. 7 is a fragmentary cross-sectional view showing the lower end of the prior art package shown in FIG. 1.

The resultant package and mirror illustrated in FIG. 1 have numerous advantages over the prior art mirrors in that it provides a compact, rigid support around the entire perimeter of the mirror and the arcuate corners 46 and strip 48 result in fixing the mirror within the package so that it cannot move in any direction. When compared to the prior art mirror and package illustrated in FIGS. 6 and 7, it will be noted that a prior art package does not support the mirror in a fixed position with the package. As shown in FIG. 6, the prior art package has a front portion 100, a rear portion 102 and an inwardly-folded arcuate portion 104 which extends across the rear surface of the mirror. There is no rigid side edge protection for the mirror, as can be seen from an inspection of FIG. 6.

Figure 7:
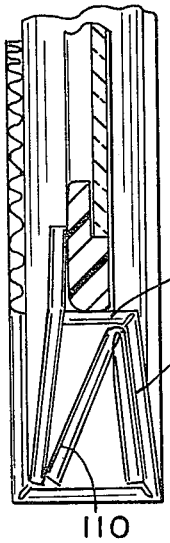
FIG. 7 PRIOR ART

Also, the end support members illustrated in FIG. 7 do not provide a rigid, compact support for the mirror. As shown therein, the end support consists of an insert 110 which is generally folded upon itself and is placed within an upwardly-directed element 112 and an inwardly-directed ledge 114 which supports the mirror bottom and top edges. The loosely designed edge support will easily collapse in the event that the mirror and package are dropped, resulting in the mirror being able to shift around within the package and possibly be damaged.

Comparing the side edge protectors of the prior art of FIG. 6 with the present invention illustrated in FIG. 3, it will be appreciated that the present package provides much better support for the mirror contained therein. Also, the compact, rigid end supports of the present invention shown in FIG. 4 provide a much better support surface than the prior art type of package end illustrated in FIG. 7.

The various flaps that are folded upon themselves may be interconnected in various ways and glue lines 100 have been shown for purposes of illustration.

As can be appreciated from the above description, the present invention provides a superior inexpensive package that can be formed from a flat sheet of stock material which has been illustrated as being a corrugated cardboard. However, other materials may be substituted for the main sheet that is folded into the ultimate package.

We claim:

1. A method of producing a package for a mirror having opposite edges and opposite ends comprising the steps of forming a flat sheet having an opening in the center and four inwardly-directed flaps, as well as four outwardly-directed flaps which ultimately define supports for opposite edges and opposite ends of said mirror, double folding said outwardly-directed flaps on opposite ends to produce at least one double ply in contiguous engagement with said sheet, folding said inwardly-directed flaps on opposite ends in overlapping relation with the double plies on opposite ends to produce rigid supports for opposite ends of said mirror.

2. A method as defined in claim 1 including the further steps of folding said inwardly-directed flaps to produce plural plies of material along opposite edges of said mirror and folding said outwardly-directed flaps into overlapping relation with said plural plies along said opposite edges and a portion of said mirror.

3. A method as defined in claim 2 in which said outwardly-directed flaps also overlap with said end double plies.

4. A method as defined in claim 2 in which said opening and said mirror are rectangular and in which said opening has arcuate portions overlapping corners of said mirror.

5. A method as defined in claim 4 in which said sheet has an integral portion extending across said opening intermediate opposite ends.

6. A mirror and package comprising a mirror having opposite edges, opposite ends, a front surface and a rear surface, said package comprising a single sheet having multiple folds along opposite sides and having a dimension greater than the depth of said edges of said mirror to protect said mirror, said sheet having multiple folds at opposite ends providing support for opposite ends of said mirror, said sheet having flaps along opposite edges with said flaps extending rearwardly along the edge of said mirror and inwardly to cover said multiple folds and a portion of said rear surface of said mirror.

7. A mirror and package as defined in claim 6 in which said sheet has an opening exposing at least a portion of said front surface for display.

8. A mirror and package as defined in claim 7 in which said mirror and opening are rectangular and said rectangular opening has arcuate corners extending across respective corners of said mirror and acting as retention means for retaining said mirror in said package.

9. A mirror and package as defined in claim 8 in which said retention means also includes a narrow strip forming part of said sheet and extending across an intermediate portion of said front surface.

10. A mirror and package as defined in claim 7 in which there are flaps extending from said opening rearwardly and in overlapping relation with edges and rear surfaces of said multiple folds.

11. A sheet adapted to be folded and secured to define a package around a mirror comprising a cardboard main body having a generally rectangular opening having a peripheral edge with opposite ends and opposite sides, a first pair of outwardly-directed end flaps, each having a plurality of spaced fold lines to be foldable in contiguous engagement with said main body, said main body having a second pair of inwardly-directed end flaps having a single fold line spaced from said peripheral edge and foldable to encompass said multiple-ply thickness, said main body having a third pair of inwardly-directed side flaps having a plurality of spaced parallel fold lines to produce a multiple-ply thickness along opposite sides of said main body and a fourth pair of outwardly-directed side flaps, each having a single fold line and foldable to encompass said multiple-ply thickness on opposite sides of said main body.

* * * * *